United States Patent [19]

Nowak et al.

[11] Patent Number: 4,691,808

[45] Date of Patent: Sep. 8, 1987

[54] ADAPTIVE ASSIGNMENT OF ELEVATOR CAR CALLS

[75] Inventors: Frederick H. Nowak, Southington; Isabel Hovey, Simsbury, both of Conn.

[73] Assignee: Otis Elevator Company, Farmington, Conn.

[21] Appl. No.: 931,599

[22] Filed: Nov. 17, 1986

[51] Int. Cl.[4] ..... B66B 1/20

[52] U.S. Cl. ..... 187/125; 187/127

[58] Field of Search ..... 187/121, 125, 127

[56] References Cited

U.S. PATENT DOCUMENTS

| | | | |
|---|---|---|---|
| 3,374,864 | 3/1968 | Port . | |
| 3,746,131 | 7/1973 | Hirasawa et al. | 187/121 X |
| 3,902,571 | 9/1975 | Iwasaka et al. | 187/121 X |
| 4,042,067 | 8/1977 | Mandel . | |
| 4,058,187 | 11/1977 | Jacoby et al. | 187/125 |
| 4,084,661 | 4/1978 | Quan et al. | 187/125 |
| 4,230,206 | 10/1980 | Brooks . | |
| 4,305,479 | 12/1981 | Bittar et al. . | |
| 4,376,930 | 3/1983 | Sasao . | |
| 4,555,000 | 11/1985 | Umeda . | |

FOREIGN PATENT DOCUMENTS 255218 8/1963 Australia .

OTHER PUBLICATIONS

Schroeder, Joris, "Judging Dispatch System Efficiency", pp. 24–25, Elevator World, Jul. 1985.

Edgett, Steven & Skidmore, Owings & Merrill, "Elevator Myths and Realities", pp. 24–28 & 30, Elevator World, Aug. 1985.

Page 15 "2100C Immediate-Prediction System . . . ".

*Primary Examiner*—William M. Shoop, Jr.

*Assistant Examiner*—W. E. Duncanson, Jr.

*Attorney, Agent, or Firm*—Gerald E. Linden

[57] ABSTRACT

At a single floor of a building, such as at the lobby, destination calls are entered via a destination call entry device touch pad such as a (12) so that overall system response can be optimized during up-peak service intervals. A maximum number of calls are assigned to each car in order of its priority, or advantageous situation with respect to loading the lobby passengers, and the dispatch interval for each car is individually adjusted. The calls may be assigned to a car prior to its arrival at the lobby, and call assignments are audibly and/or visually displayed by an indicator device (16).

9 Claims, 14 Drawing Figures

ADAPTIVE ASSIGNMENT OF ELEVATOR CAR CALLS

TECHNICAL FIELD OF THE INVENTION

The invention relates to elevator systems having two or more cars and, more particularly, to the assignment of cars in response to calls entered by passengers at a particular floor or landing, such as at the lobby of a building.

BACKGROUND OF THE INVENTION

Typically, at each floor of a building there is provided an "up" call button and a "down" call button that a putative passenger can press to request an elevator car. (At the uppermost floor there would only be a "down" button, and at the bottommost floor, or lobby, there would only be an "up" button.) Various schemes have been implemented for assigning particular cars to particular calls, the object being minimizing the overall elevator system response time to all of the car calls. For instance, if there are down car calls entered at the 9th, 10th, 11th, 21st, 22nd, and 23rd floors, one elevator car may be assigned to the 9th, 10th, and 11th floor down car calls while another elevator car is assigned to the 21st, 22nd, and 23rd floor down car calls.

Upon entering a car, the passenger registers a destination call on the car operating panel within the car. This introduces a degree of uncertainty into the system in that the elevator cars could have been more appropriately assigned to the car calls had the passenger's destination (rather than only his desired direction of travel) been known in advance. This degree of uncertainty is manifested in less than optimum overall system response time.

Therefore it has been known, but not widely employed, to provide a "touch pad" at each floor of a building whereby a passenger can enter his ultimate destination prior to the elevator arriving to service his call, rather than only being able to enter a call indicative of his desired direction of travel. Such a system is disclosed in Australian Patent No. 255,218, issued to Leo Port in 1961. A reason for the limited acceptance of a so-called "Port" system, and its derivatives, is that such a system requires touch pads and their associated wiring at each floor, which adds substantial cost to the system hardware and installation.

DISCLOSURE OF THE INVENTION

It is an object of this invention to provide an elevator system wheren destination calls can be entered by a passenger prior to boarding the elevator car, thereby providing a substantial improvement in elevator response time.

According to the invention, a destination call entry device, such as a touch pad is provided at a single, heavily trafficed floor in a building, such as at the lobby. Thereby, a passenger is able to enter his desired destination prior to an elevator car arriving to service his call. For simplicity of description, it is assumed that the touch pad is at the bottommost floor (i.e., at the lobby) and that all of the destination calls will be in the "up" direction, away from the lobby.

In conjunction with providing the touch pad at the lobby only, a unique scheme of car assignment is employed.

According to the invention, the calls entered at the lobby touch pad are assigned to cars in the following order of priority:

a. highest priority—cars at the lobby with their doors open;

b. lower priority—cars at the lobby with their doors closed;

c. yet lower priority—cars running toward the lobby having the lobby as their next stop; and d. lowest priority—the car running towards the lobby with the soonest predicted arrival time.

Only a limited number of calls are assigned to each car. This number is derived by dividing the number of floors above the lobby by the number of cars in service. The calls assigned to a car are visually (and, optionally, audibly) displayed at the lobby so as to direct passengers to the proper cars. Assigning a call to a car and visually displaying this assignment in the lobby to direct passengers to the elevator they must use has the effect of concentrating passengers with a common destination—hence, delivering more passengers per service stop. This minimizes each car's round trip time by reducing the number of service stops it makes during each round trip.

In further accord with the present invention, the dispatch interval for each car may be dynamically adjusted as a function of the number of calls assigned to it, its position relative to the lobby at the time that calls are assigned to it, and the estimated number of passengers having boarded the car once it arrives at the lobby to accept passengers.

This has the effect of slightly delaying the dispatch (departure) of the car and allowing destination calls to be assigned to the car for "stragglers", i.e., late-arriving passengers. This feature is most effective in optimizing overall system responsiveness in the context of "up-peak" service intervals when there is a heavy influx of passengers at the lobby and may be eliminated as a feature during non-up-peak service intervals.

Other objects, features, and advantages of the invention will become in light of the following description thereof.

BRIEF DESCRIPTION OF THE DRAWINGS

FIGS. 1B and 2 through 7D are flowcharts illustrating in greater detail a particular computer program implementing the Adaptive Assignment of Elevator Car Calls concept of the present invention.

FIG. 1B is a flowchart of the initiation and basic operating conditions section of the program, as suited to the microprocessor based elevator system of FIG. 1.

FIGS. 2–4 and 5A–5C are flowcharts of the car selection sections of the program.

FIG. 6 is a flowchart of the call assignment section of the program.

FIGS. 7A–7D are flowcharts of the interval calculation and car dispatch sections of the program.

BEST MODE FOR CARRYING OUT THE INVENTION

Figure 1:
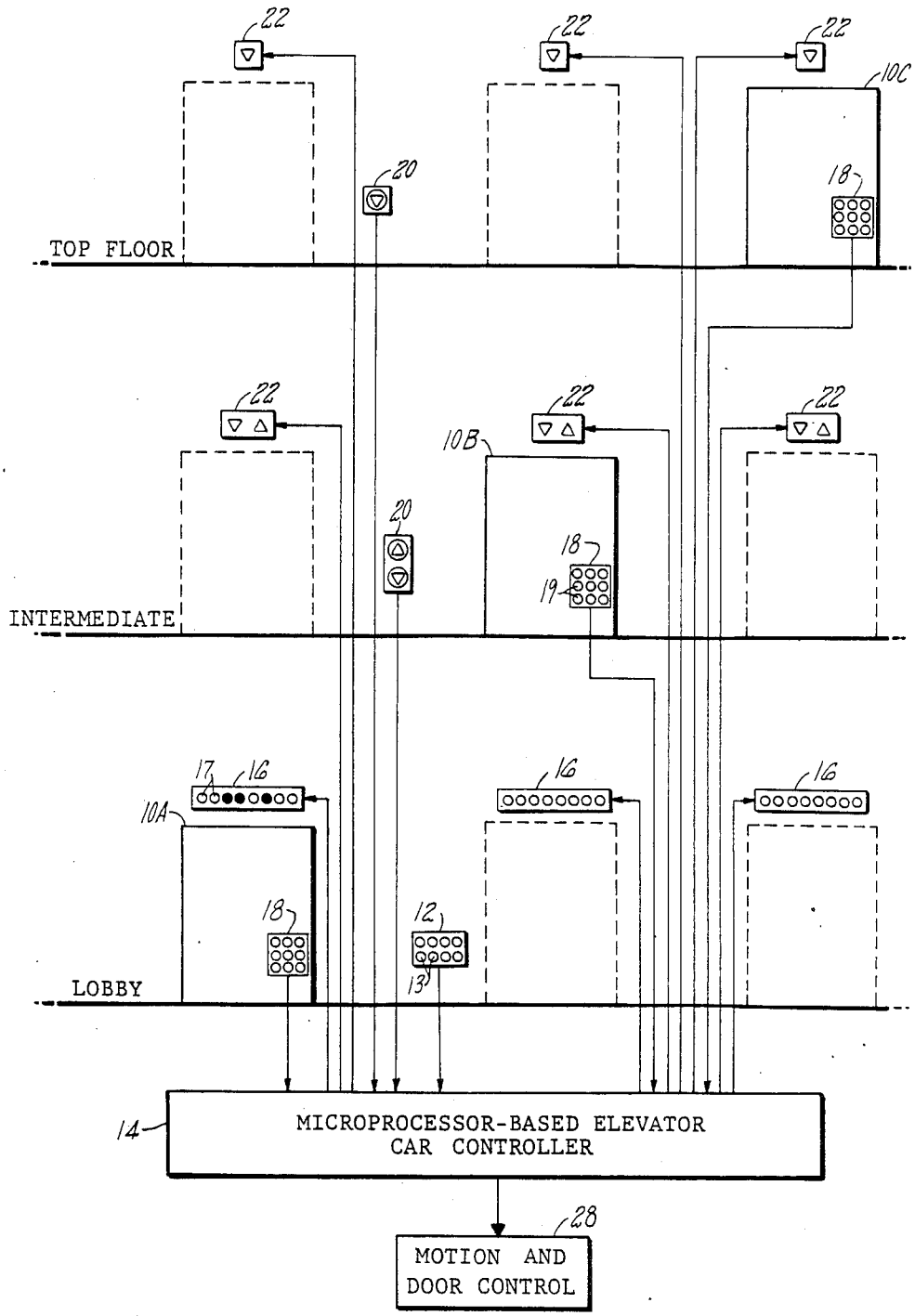
FIG. 1 is a schematic block diagram of an elevator system employing the present invention.

FIG. 1 shows a microprocessor-based elevator system comprising three cars 10A, 10B, and 10C, each at a distinct landing in a building. At one floor, herein the "lobby", there is disposed a destination call entry device, such as a touch pad 12 having a plurality of buttons 13, each button associated with a particular floor away from (in this case, above) the lobby. When a passenger desires to call a car for "up" service from the lobby, he would depress the button for his desired destination, which would cause a signal to be sent to a microprocessor-based controller 14 that exercises control over all of the elevator cars 10A, 10B, and 10C. It is conceivable that another form of destination call entry device could be used, such as a voice-recognition module or an encoded card reader, or a handheld transmitter.

As will be described in much greater detail hereinafter, in response to a plurality, or set, of destination calls entered at the touch pad 12, the controller 14 assigns a particular car to service a particular subplurality, or subset, of those calls. Another car is assigned by the controller to service another subset of those calls, and so forth, until all of the calls have been assigned to a car.

According to an aspect of this invention, a maximum number of calls to be assigned to each car is determined as the number of floors above the lobby divided by the number of cars in service. The maximum number of calls is assigned preferentially to cars at the lobby with their doors open, if there are any, next in order of preference to cars at the lobby with their doors closed, next in order of preference to cars headed towards the lobby with the lobby as their next stop, and last in order of priority to the car headed towards the lobby with the soonest predicted arrival time.

In order that passengers will be directed to the particular car that has been assigned to service their call, an indicator (display) device 16 is located in the lobby above each car (i.e., above the lobby doors). Each display device 16 has a plurality of individual lanterns 17 which are numbered in correspondence with the floors above the lobby. As an example, if the controller has assigned calls for the 4th, 5th, and 7th floors to the car 10A, the appropriate lanterns 17 on the display device associated with the car 10A would be illuminated, as shown. It will become more evident hereinafter exactly how this function is achieved by the system, and that the lanterns may be illuminated prior to the arrival of the car to which those subset of destination calls have been assigned.

According to an aspect of this invention, a basic dispatch interval is established for the cars, and adjusted to an individualized dispatch interval for each car as will be explained in greater detail hereinafter.

It should be noted in FIG. 1, that each car is equipped with a car operating panel 18 containing a plurality of buttons 19, each button being associated with a floor in the building. The car operating panel is certainly not necessary for lobby passengers who have entered their destination calls on the touch pad 12 in the lobby. However, the car operating panel is required for passengers at any other floor to enter their destination calls in accordance with traditional techniques of elevator operation. To this end, at floors above the lobby, there are provided the usual car call buttons 20 and car arrival indicators 22. Both the buttons 20 and the indicators 22 are associated with an "up" and/or a "down" direction of travel for a particular car.

The microprocessor-based controller 14 exercises control over the motion of the cars and their doors in an otherwise traditional manner, as indicated by the block 28. U.S. Pat. No. 4,367,810, issued to Doane, et al in 1983, and entitled Elevator Car and Door Motion Interlocks, describes these functions in greater detail, and is herein incorporated by reference for that purpose.

As noted hereinbefore, one of the primary advantages of the present invention is that at all floors but one, in this example the "lobby", traditional hardware is employed and traditional elevator operation ensues therefrom. It is by providing a touch pad at a single floor that optimized elevator service without prohibitive cost is achieved. The particulars of how the touch pad 12 is interactive with the controller 14 in achieving optimized elevator service is discussed with respect to software instructions which could be readily implemented by one of ordinary skill in the art to which this invention pertains in a microprocessor-based elevator system such as that illustrated in FIG. 1.

Figure 1A:
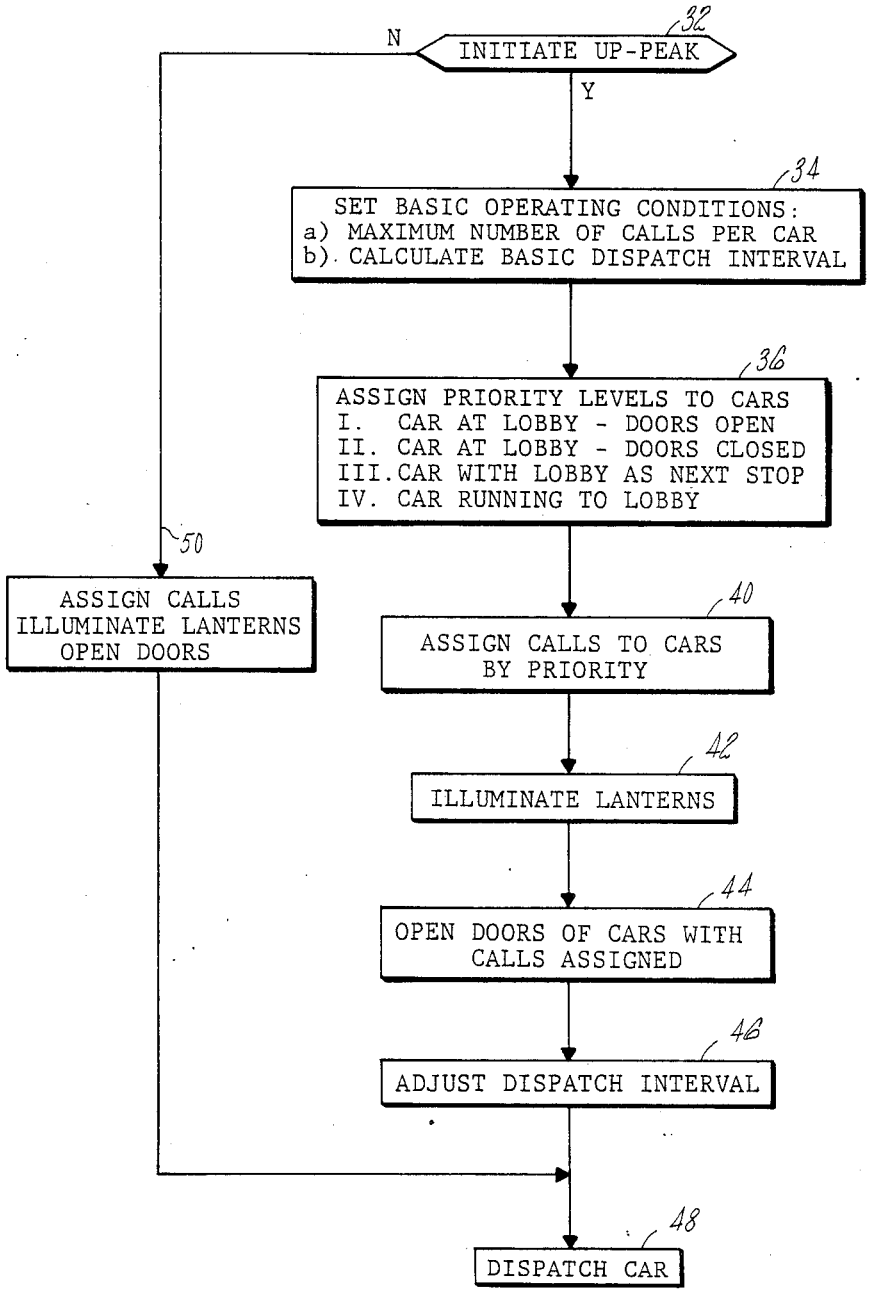
FIG. 1A is a macro-flowchart illustrating the basic scheme of the present invention as implemented in a microprocessor-based elevator system such as that disclosed in FIG. 1.

FIG. 1A shows a set of software "blocks" descriptive of the elevator operation technique of this invention.

In a step 32 it is determined whether to initiate up-peak service. This determination may be based on conventional techniques of sensing the loading of elevators leaving the lobby and/or a time of day clock that is predictive of heavy incoming traffic at the lobby. Initiation of up-peak service is described in greater detail in U.S. Pat. No. 4,305,479, issued to Bittar, et al in 1983, and entitled Variable Elevator Up Peak Dispatching Interval, and is herein incorporated by reference.

Next, in a step 34 basic operating conditions for the system are set. A maximum number of destination calls that may be assigned to each car is calculated as the number of floors above the lobby divided by the number of cars in service. A basic dispatch interval is calculated as the maximum number of passengers permissible per car (based on the duty load of the car), multiplied by the ratio of the total number of cars in the group to the number of cars in service, multiplied by a proportionality constant. It will be evident hereinafter how the basic dispatch interval is adjusted.

Next, in a step 36 the cars are assigned a priority level for response to the lobby-entered (i.e., touch pad), destination calls. The priority levels are hierarchical, and are as follows; the highest priority (Priority 1) is given to cars at the lobby with their doors open, the next highest priority (Priority 2) is given to cars at the lobby with their doors closed, the next highest priority (Priority 3) is given to cars running towards the lobby and already committed to make the lobby their next stop, and the lowest priority (Priority 4) is given to the car running toward the lobby, with the soonest predicted arrival time at the lobby based on the calculation of its running time, and its known service stops (if any).

A general assumption is made that cars running toward the lobby will have relatively few intermediate service stops during up-peak service intervals—hence, have a high predictability of lobby arrival time. Cars running away from the lobby, however, always have service stops and therefore their arrival times are less predictable. Therefore, such cars have no priority, and are not assigned until they reverse.

In all cases, cars which have been assigned their maximum allocatable number of calls are no longer eligible for further call assignments, regardless of priority status.

Next, in a step 40, the car with the highest priority is selected for call assignment. (The destination calls have been provided to the controller via the touch pad 16 of FIG. 1.) Destination calls are assigned to it until its quota (maximum number of calls as determined in the step 32) is filled. The system then seeks the next highest priority level car for assignment of the remaining pending (unassigned) calls, and so forth, until all pending calls are assigned.

In a step 42, the lanterns 17 (of FIG. 1) of a display device 16 associated with a car are illuminated in correspondence with the car's call assignment(s). This may be done before the car actually arrives at the lobby so as to promote the awareness of the passenger as to which car will be servicing his destination call.

In conjunction with the step 42, at a step 44, the doors are opened of those cars at the lobby which have calls assigned to them. By keeping the doors of unassigned cars closed, confusion as to which car a passenger should enter will be alleviated.

Next, in a step 46, a dynamically adjusted dispatching interval is calculated for each car that has at least one destination call assigned to it. The basic dispatching interval, calculated in the step 34 above, is adjusted as follows:

If the car is already at the landing, the calculated basic dispatching interval is used as a starting basis.

If the car is still running toward the lobby, the basic dispatching interval is multiplied by a fractional constant (typically 0.5). This reasoning is based on the presumption that some passengers, having been informed which car to use prior to its arrival, will be waiting at its entrance and ready to board it immediately. Hence, the difference in service times for passengers boarding cars waiting at the lobby and those waiting for cars to arrive is minimized.

For each new assigned destination call, a subtraction is made from the basic dispatching interval.

For each boarded passenger (determined by load weighting), an additional subtraction is made from the basic dispatching interval for a car at the lobby.

After each fresh destination call assignment, the length of the remaining dispatching interval is checked against a constant (typically 8 seconds). If the remaining interval is less than the constant, it is increased to its value (8 sec.) to provide sufficient boarding time.

After detection of the last boarded passenger (by load weighing), the length of the remaining dispatching interval is checked against a constant (typically 4 sec.). If the remaining interval is less than the constant, it is increased to its value (4 sec.) on the presumption that the last passenger has not yet boarded. This option may or may not be used, depending upon the stability of the load weighting signal. It is easy to void in the field.

An interval countdown timer starts operating immediately for each established interval. Each car's interval and timer are totally independent of any other cars' intervals and timers.

In a step 48, at the expiration of the dispatching interval, the doors are closed to permit the car to start. At this instant, the destination call assignment is removed from the car to allow an ensuing destination call to the same location to be assigned to another car.

In conjunction with the highly optimized techniques of this invention for servicing lobby calls, one will readily appreciate that nonlobby calls must be attended to. This is done in a reasonable, conventional manner. Nonlobby calls (entered at the devices 20 of FIG. 1) are preferentially assigned to cars away from the lobby (Priority 3 or 4) or, in their absence, to cars at the lobby which have destination calls assigned and will be dispatched within a reasonable interval.

During non-up-peak service intervals, destination calls entered at the lobby touch pad 16 of FIG. 1 may be assigned in an unoptimized manner according to traditional techniques. In other words, the number of calls per car would not be optimized (step 40) and the dispatch interval would not be adjusted (step 46). This is represented by the path 50.

FIGS. 1B and 2 through 7D describe the aforementioned software in greater detail.

Figure 1B:
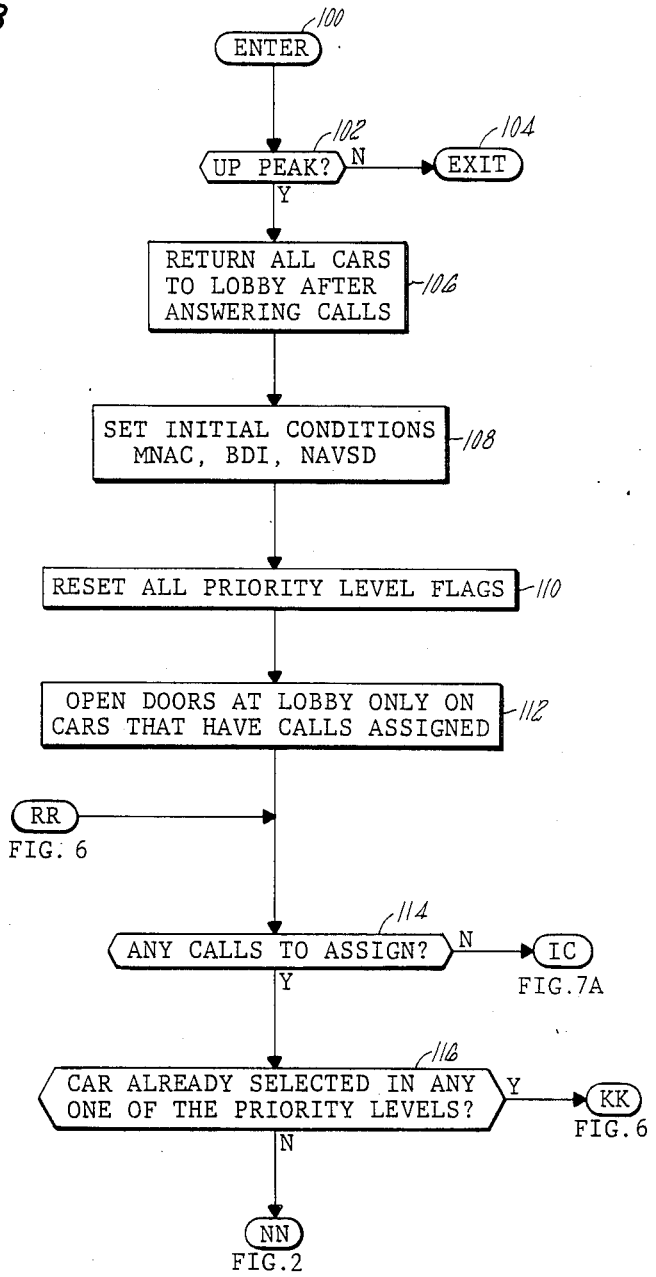

FIG. 1B shows the initiation of up-peak service and initial conditions setup portions of the ACA program. Initiation of up-peak service may be performed in any traditional manner, such as by a clock or by a sensed heavy influx of lobby traffic. Such techniques are discussed in commonly-owned U.S. Pat. No. 4,305,479 (Bittar, et al., 1981). The initial conditions are to determine the number of (currently) available cars, the maximum number of destination calls that can be assigned to each available car, and the resultant "basic" dispatching interval.

The routine of FIG. 1B is entered at a step 100. At a step 102, it is determined whether the up-peak mode of service has been initiated.

If up-peak service is not initiated, the routine exits at a step 104. If up-peak service is initiated, at a step 106 a lobby call is imposed upon any car that is above the lobby and has answered all of its calls. If there are calls to assign, then, certain initial conditions are established in a step 108. These include:

Determine the number of currently available cars in service (NAVSD);

Determine the maximum number of calls assignable to each car (MNAC), which equals the of landings above the lobby divided by NAVSD.

Calculate the Basic Dispatching Interval (BDI), which equals the maximum number of passengers per car (based on duty load), multiplied by the ratio of number of cars in the group (p) to the number of cars in service (NAVSD), multiplied by a proportionality constant K1.

Then, in a step 110 the flags for Priority Levels 1–4 (discussed hereinafter) are reset, and in a step 112 the doors for lobby cars with calls assigned (discussed hereinafter) are opened.

Figure 6:
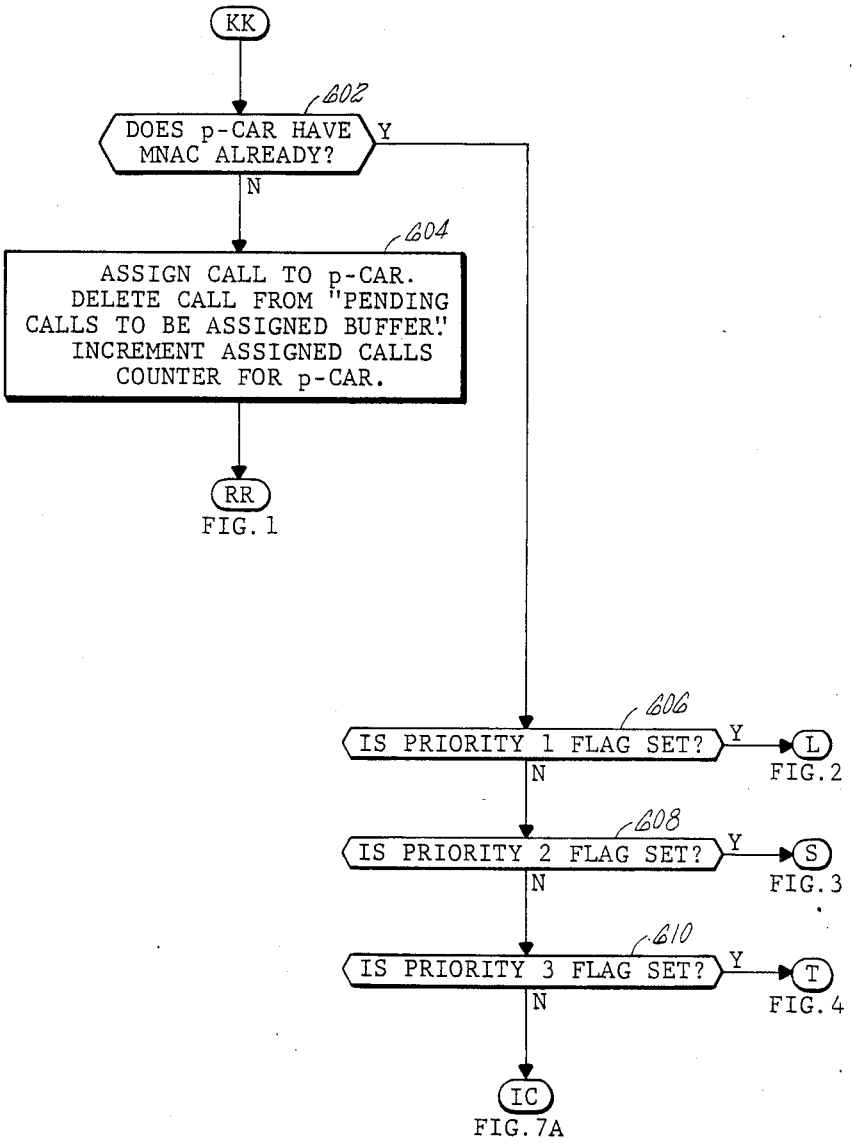
Figure 7A:
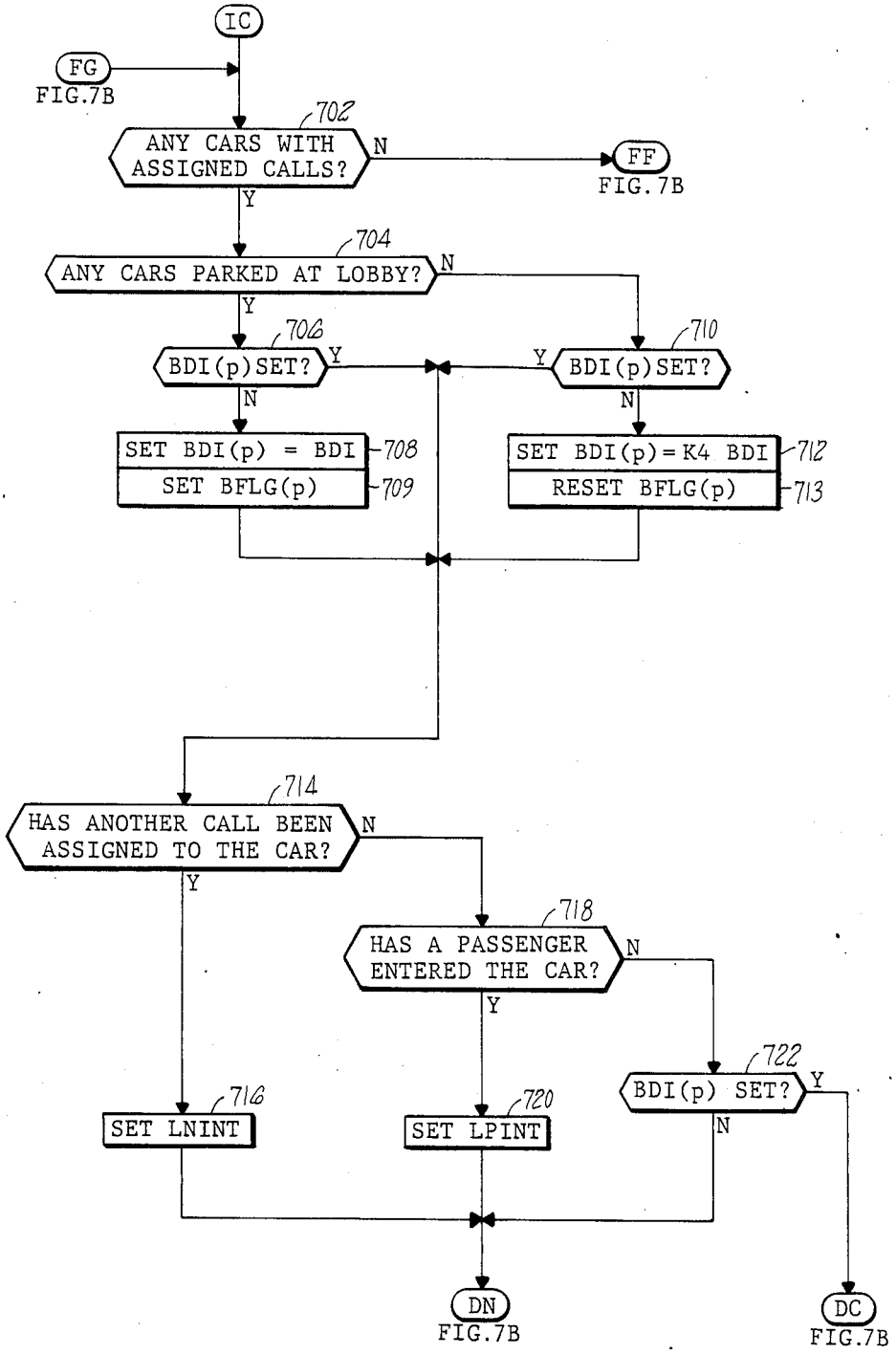
Figure 7B:
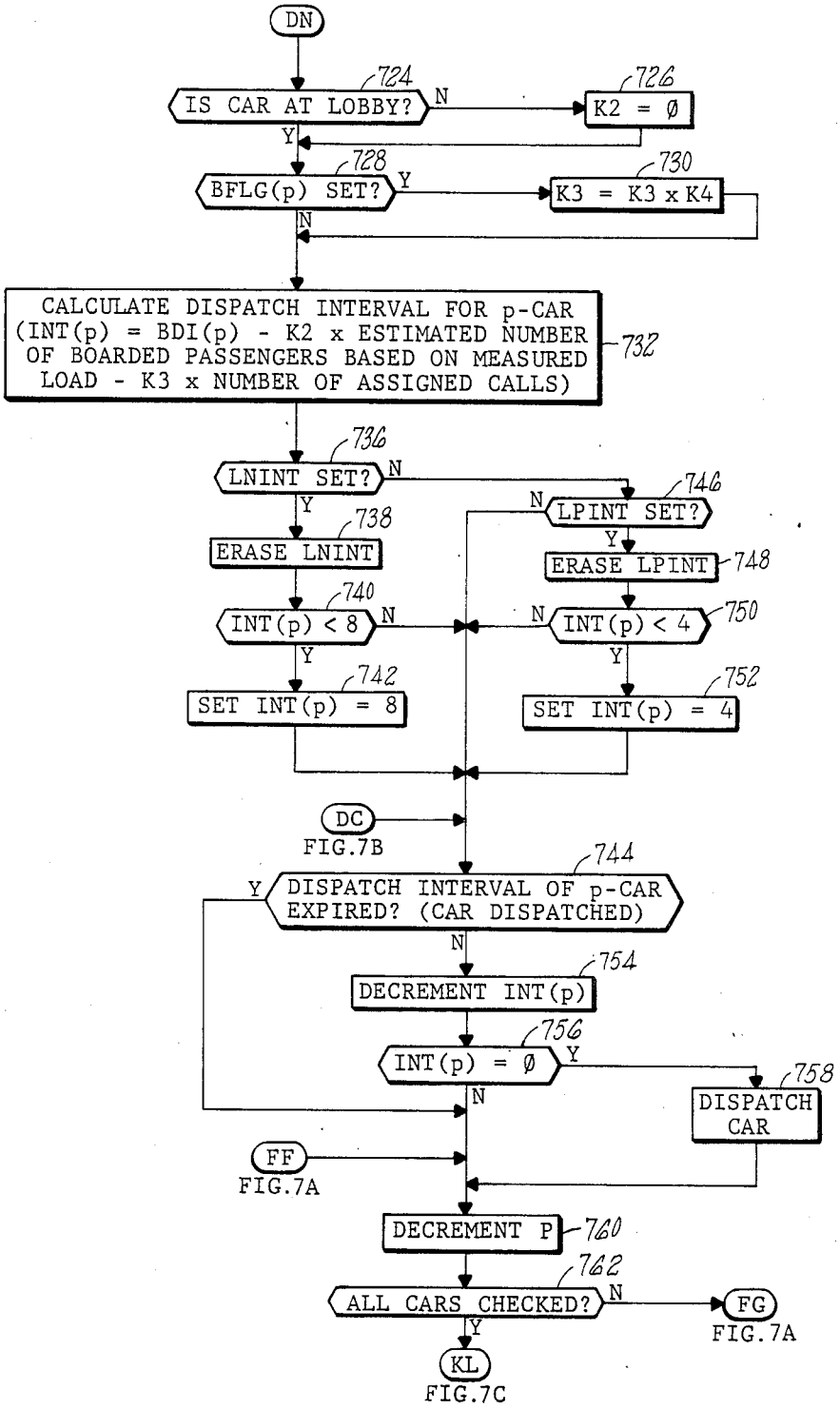

Next, in a step 114 it is determined whether there are any lobby-entered destinations calls to assign, the routine proceeds to IC of FIG. 7A. If there are calls to assign, it is determined in a step 116 whether a car has already been selected for call assignment, in which case the routine proceeds to KK of FIG. 6 to assign calls to that car. If no car has already been selected, the routine proceeds to NN of FIG. 2 to select a car for call assignment.

FIGS. 2, 3, 4, 5A, 5B and 5C comprise the Car Selection Section of the program. Priority is given to cars that have the soonest availability—real, if possible—otherwise predicted. Only cars that have calls assigned keep their doors open at the lobby, to minimize possible confusion.

Figure 2:
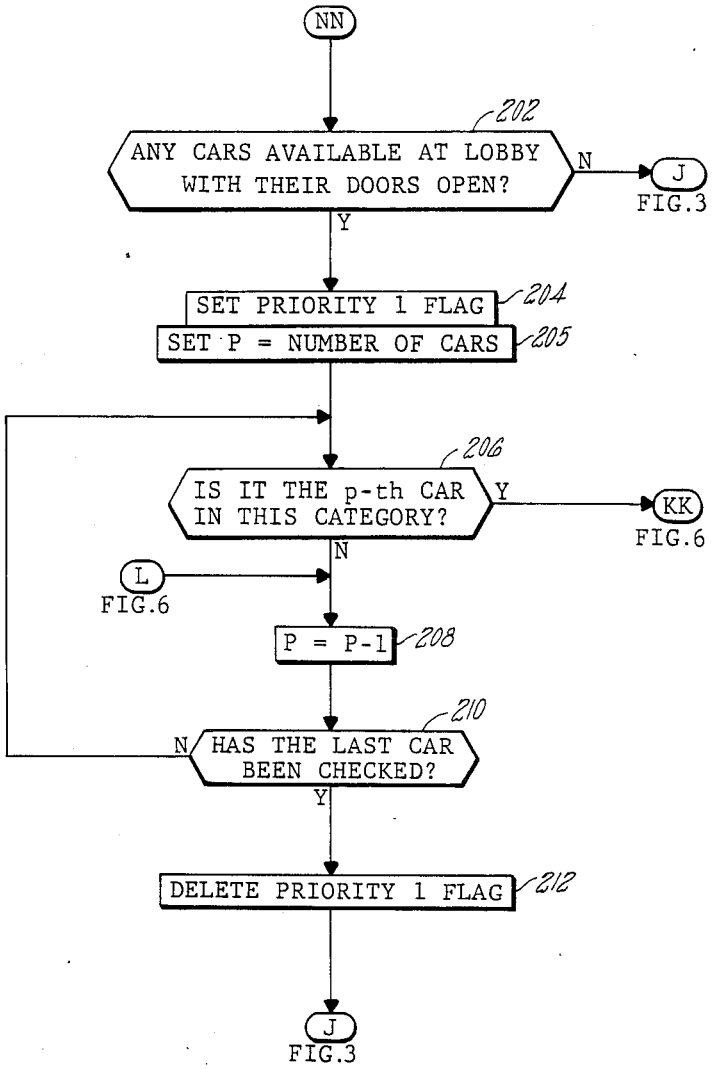

The routine of FIG. 2 is entered at NN. In a step 202 it is determined whether there are any Priority 1 cars available for call assignment, i.e., cars at the lobby with their doors open. Typically this would be done by comparing a p-bit word (p=number of cars) to ZERO, where each bit corresponds to a particular car and is set if the car is Priority 1.

Figure 3:
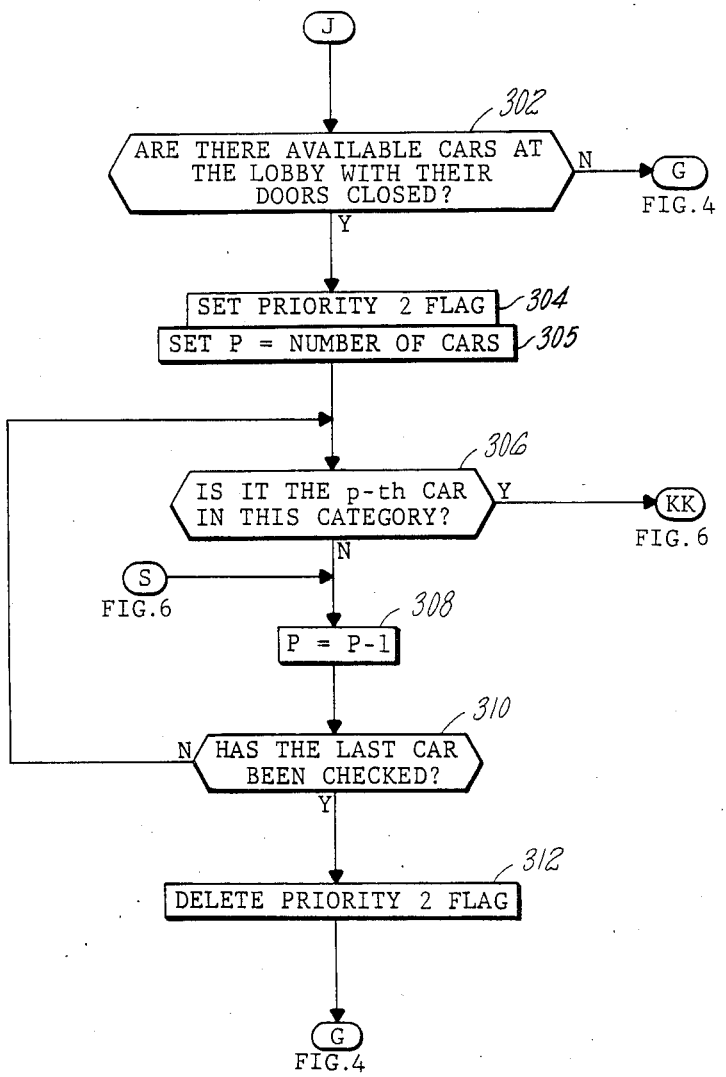

If there are no cars available at Priority 1, the routine proceeds to J of FIG. 3 to check for the availability of Priority 2 cars. If a car (or cars) is available at Priority 1, a flag is set in the step 204, p is set to the number of cars in a step 205, and a loop (steps 206, 208, 210) is entered which will identify the particular car.

In a step 206, the p-th bit of the p-bit word is checked (for a ONE in the p-th bit to see if car #p is at Priority 1. If it is, the routine proceeds to KK of FIG. 12 for assignment of calls to the Priority 1 car #p. If car #p is not at Priority 1, p is decremented by ONE at a step 208, and it is determined in a step 210 whether all of the cars have been checked for Priority 1 status. If they have not all been checked ($p \geqq 0$) the next bit of the p-bit word is checked to see if car #p-1 is at Priority 1, and so on in the loop (206,208,210) until a car at Priority 1 is found (step 206=yes).

As will become apparent hereinafter, the loop (206,208,210) is entered at the step 208, via L from FIG. 6, when an initial Priority 1 car has been assigned its full complement of calls and another Priority 1 car is searched for.

Eventually all the cars will have been checked for Priority 1 ($p<0$ in the step 210), so the Priority 1 flag which was set at the step 204 is deleted at the step 212. The routine then proceeds to J of FIG. 3 to check for Priority 2 cars.

Figure 4:
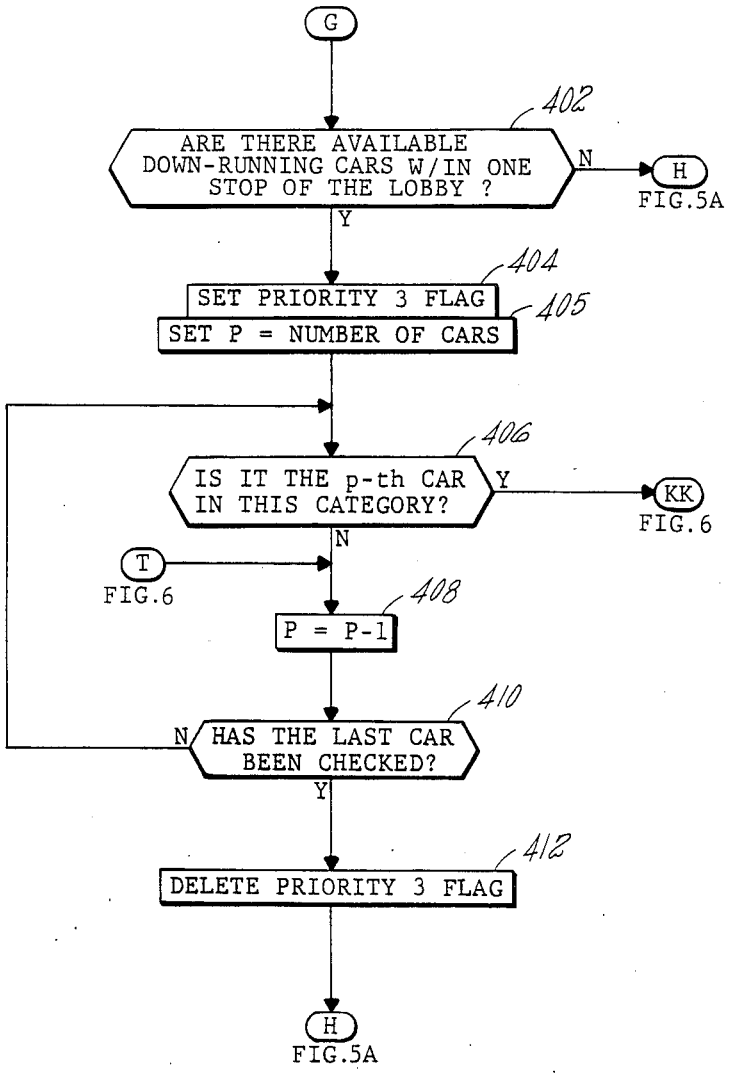

FIGS. 3 and 4 are conceptually identical to FIG. 2 in that they search for Priority 2 and Priority 3 cars, respectively. Thus, the steps corresponding to the steps 202–212 of FIG. 2 are correspondingly numbered 302–312 and 402–412, respectively. The appropriate entry and exit points are clearly marked.

Figure 5A:
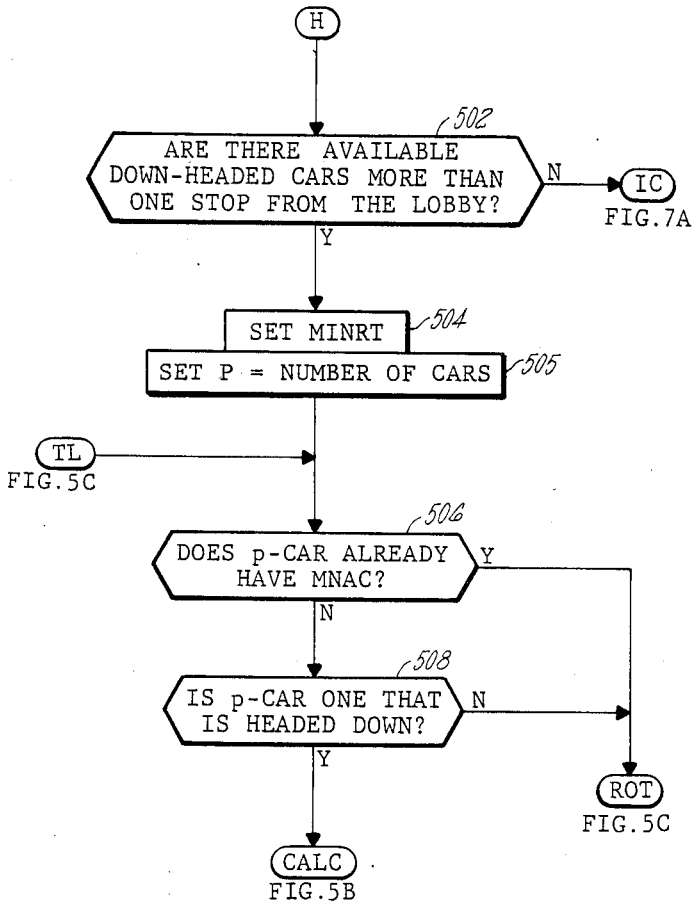

If there are no Priority 3 cars available (FIG. 4), or if there was at least one Priority 3 car and all cars have been checked at the Priority 3 level, the routine proceeds to H of FIG. 5A to find the best Priority 4 car.

The routine of FIG. 5A is entered at H. In a first step 502 it is determined whether there are any cars headed down (stopped or running), but more than one floor (or express zone) away from the lobby; i.e., Priority 4 cars. If not, the routine proceeds to IC of FIG. 7A. If there are any Priority 4 cars available the "best" one—the one with the minimum expected arrival time at the lobby will be selected for destination call assignment. Since there is no foolproof way to predict the arrival time of a car running down (if there are any car calls or intervening hall calls), the expected arrival time is calculated based on a series of well-reasoned assumptions.

In order to determine which Priority 4 car has the soonest arrival time, a minimum running time value (MINRT) is initialized at a step 504, to a large value (such as ½ hour) which is beyond any reasonable actual value. In a step 505 p is set to the number of cars.

Next, in a step 506 it is determined whether any of the p- cars already have the maximum number of up-peak calls assigned (MNAC). This, of course, is not relevant in the initial pass of the program. If there are already p-cars with the maximum number of calls assigned, the routine proceeds to ROT of FIG. 5C to select another car. Otherwise, the routine proceeds to a step 508 wherein it is determined whether the p- car is a Priority 4 car. If not, the routine proceeds to ROT of FIG. 5C. Otherwise, the routine proceeds to CALC of FIG. 5B.

Figures 5B, 5C:
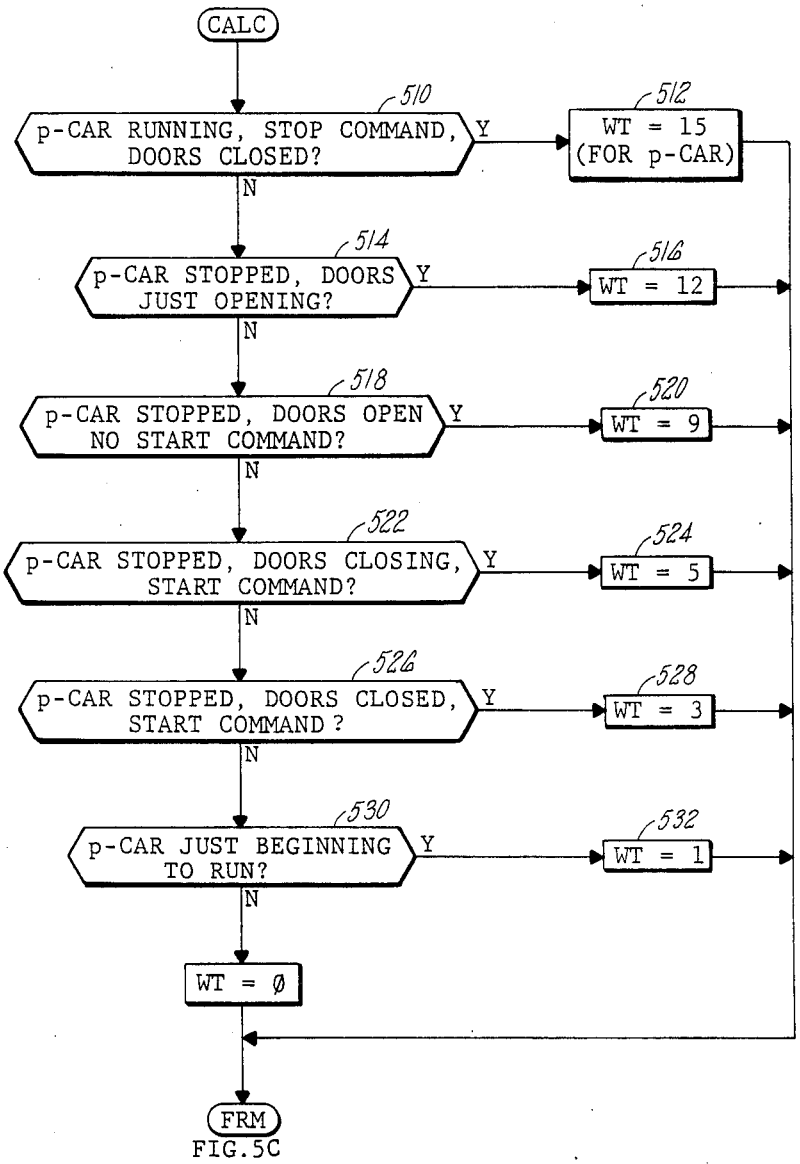
Figure 5C:
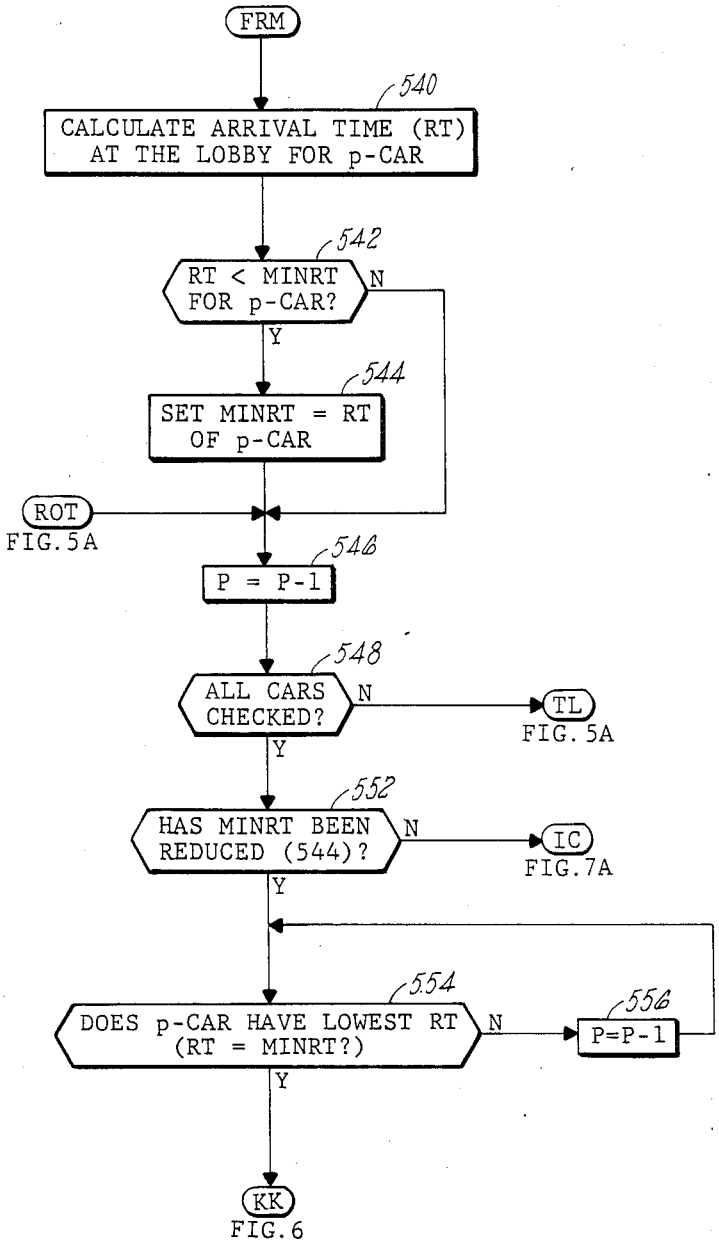

In the routine of FIG. 5B, which is entered at CALC, one of a set of hierarchial weighting factors are assigned to a Priority 4 car which is servicing, or has just serviced an intervening down call. As will be seen hereinafter, this weighting factor is added to other factors relevant to the down-headed car to calculate its estimated arrival time at the lobby.

Thus, in a first step 510 it is determined whether the p- car is running with a stop command and its door closed. If it is, a weighting factor (WT) of 15 time units, such as seconds is assigned to the p- car in a step 512 and the routine proceeds to FRM of FIG. 5C. If it is not, in a step 514 it is determined whether the p- car is stopped with its door just opening. If it is, a weighting factor of 12 seconds is assigned to the p- car in a step 516 and the routine proceeds to FRM of FIG. 5C. If it is not, in a step 518 it is determined whether the p-car is stopped with its doors open and no start command. If it is, a weighting factor of 9 seconds is assigned to the p- car in a step 520 and the routine proceeds to FRM of FIG. 5C. If it is not, in a step 522 it is determined whether the p-car is stopped with its doors closing and a start command. If it is, a weighting factor of 5 seconds is assigned to the p- car in a step 524 and the routine proceeds to FRM of FIG. 5C. If it is not, in a step 526 it is determined whether the p- car is stopped with its doors closed and a start command. If it is, a weighting factor of 3 seconds is assigned to the p-car in a step 528 and the routine proceeds to FRM of FIG. 5C. If it is not, in a step 530 it is determined whether the p- car is just beginning to run. If it is, a weighting factor of 1 second is assigned to the p- car in a step 532. If it is not, the car is running and no weighting factor ($WT=0$) is assigned to the p- car and the routine proceeds to FRM of FIG. 5C.

The routine of FIG. 5C is accesses at FRM, after the weighting factor (if any) for a down-running car servicing a call has been set in FIG. 5B.

In a first step 540 the arrival time (running time) for the p- car is calculated as the sum of the weighting factor for the p- car plus a factor related to the contract speed of the p- car and its distance from the lobby plus 15 seconds times the number of intervening calls ahead of the p- car (15 seconds is chosen as a typical time to service an intervening call).

Next, in a step 542 it is determined whether the calculated arrival for the p- car is less than the minimum running time value (MINRT) selected at the step 504 of FIG. 5A.

If the calculated running time for the Priority 4 car being checked is less than MINRT, it is substituted therefor in a step 544. Then in a step 546 a counter (p) is decremented so that on the next pass the next car will have its calculated running time tested against MINRT. If the running time for the car is not less than MINRT in the step 542, the step 544 is bypassed.

It will be noted that the step 546 may be directly accessed via ROT from FIG. 5A, which will occur either if any of the cars already have the maximum number of destination calls assigned (step 506 affirmative) or if one of the tested cars is not a Priority 4 car (step 508 negative).

Next in a step 548, it is determined whether all of the cars have had their calculated running times checked. If not, the program proceeds to TL of FIG. 5A to continue to check the next car. Otherwise, in a step 552 it is determined whether the present value of MINRT (which may have been reduced in the step 544) is less than its original value (which was set in the step 504 of FIG. 5A. If it is not less, no car was found with a lesser running time than the original MINRT, and the program proceeds to IC of FIG. 7A. If it is less, the car with the lowest running time is acceptable for call assignment. The car is identified by comparing the calculated running time of the p-th car to the present value of MINRT in a step 554 and decrementing p in a step 556 in a small search loop until the correct car is found, at which point the result of the step 554 is affirmative, and the program proceeds to KK of FIG. 6 for assignment of calls to the selected car.

FIG. 6 is the Call Assignment Section of the ACA program. Calls are assigned to the selected car until its quota is filled.

The routine of FIG. 6 is accessed at KK. In a first step 602 it is determined whether the number of calls assigned to the selected p- car is at the maximum number (MNAC) ascertained at step 108 of FIG. 1. On the first pass the result would be negative, and the routine proceeds to a step 604 wherein the call is assigned to the selected p- car, the call is deleted from a register (buffer) of the pending calls, and a car call counter (NADC) is incremented, and thence to RR of FIG. 1B to look for another call.

If the selected car has been assigned its maximum number of calls (step 602 affirmative), the program searches for another car for assignment of calls. Thus in a step 606 it is determined whether the Priority 1 flag is set (step 204, FIG. 2). If it is, the routine proceeds to L of FIG. 2 to search for another Priority 1 car.

If the Priority 1 flag is not set at the step 606, in a step 608 it is determined whether the Priority 2 flag is set (step 304, FIG. 3). If it is, the routine proceeds to S of FIG. 3 to search for another Priority 2 car.

If the Priority 2 flag is not set at the step 608, in a step 610 it is determined whether the Priority 3 flag is set (step 404, FIG. 4). If it is, routine proceeds to T of FIG. 4 to search for another Priority 3 car.

If the Priority 3 flag is not set at the step 610, the routine proceeds to IC of FIG. 7A.

FIGS. 7A–7E are the Interval Calculation and Car Dispatching Section of the ACA program. The basic dispatching interval (step 108, FIG. 1) is modified for each car, depending on the number of assigned calls and the estimated number of boarded passengers. The basic dispatching interval is also shortened if calls are already assigned to the car before it arrived at the lobby. It can be assumed that many passengers, having been informed visually which car to use, will be waiting at its entrance when it arrives. Hence, the difference in total service time for a passenger boarding a car which was already at the lobby as he registered his call, and for a passenger who has to wait for his cars arrival should be minimal.

The routine of FIG. 7A is accessed via IC. In a first step 702 it is determined whether there are any cars with assigned calls. If there are not, the routine proceeds to FF of FIG. 7B. Next, in a step 704 it is determined whether the car with calls assigned to it is parked at the lobby (step 702 affirmative), the thinking being that it would take more time for passengers to board a lobby car (Priority 1 or Priority 2) than a nonlobby car (Priority 3 or Priority 4), since the hall-located call assignment indicators associated with an arriving car are lit prior to its arrival (they are lit upon call assignment) and passengers would congregate at the car entrance prior to the arrival. Thus, if the car is already at the lobby (step 704 affirmative), it is determined in a step 706 whether the Basic Dispatch Interval for the p-car BDI(p) has been set (which it would not have been on the first pass of the program), and if it has not, in a step 708 the Basic Dispatch Interval for the p- car BDI(p) is set to the Basic Dispatch Interval (BDI, step 108, FIG. 1) and a B- flag is set for the p- car. If the car is not already at the lobby (step 704 negative) it is checked in a step 710 whether BDI(p) has been set, and if it has not, in a step 712 the basic dispatch interval for the car BDI(p) is set to a fraction K4, such as one-half of the Basic Dispatch Interval (BDI, step 108, FIG. 1) and the B- flag for the p- car is reset at 713.

Next, the program proceeds to a step 714 where it is determined whether another call has been assigned to the car since the last pass of the program. If the car has received another call, a flag (LNINT) is set in a step 716 and the program proceeds to DN of FIG. 7B. If the car has not received another call, it is determined in a step 718 whether a passenger has entered the car since the last pass of the program (by loadweighing). If someone has entered, a flag LPINT is set in a step 720 and the routine proceeds to DN of FIG. 7B. If no one has entered the car and the dispatch interval for the car has already been set, as determined in a step 722, the routine proceeds to DC of FIG. 7B, but if the dispatch interval has not already been set the routine proceeds to DN of FIG. 7B.

The routine of 7B is accessed via DN. In a first step 724, it is again determined whether the car is parked at the lobby (with calls). If it is not, a constant K2 is set to zero at a step 726. Then, at a step 728 it is determined whether the car now at the lobby had its Basic Dispatch Interval BDI(p) originally calculated on the basis of not yet being at the lobby. If so, (BFLG set at 713) the constant K3 is multiplied by K4 in a step 730. The preceeding steps 700–730 serve to establish constants and flags for calculation of the dispatch interval for an assigned car. The interval is now calculated as follows.

In a step 732 the dispatch interval for the car INT(p) is calculated as the Basic Dispatch Interval of the car BDI(p) reduced by a first factor relating to the estimated number of people in the car and a second factor relating to the number of calls assigned to the car. The first factor is K2 divided by 150 pounds per passenger, times the measured load in the car. The second factor is K3 times the number of calls assigned to the car. It will be noted that K2 is zero for a car not yet at the lobby (step 726) (At this point a flag would be set so that on an subsequent passes of the program, the steps 706,710, and 722 would register affirmative.).

Next, in a step 736 it is determined whether the LNINT flag is set (step 716, FIG. 7A). If it is set, it is erased in a step 738 and in a step 740 it is determined whether the interval for the car (step 732) is less than 8 time units (such as seconds). If it is less than 8 seconds, it is set to 8 seconds in a step 742 and the routine proceeds to a step 744. If the car interval is equal to or greater than 8 seconds, the routine proceeds directly to the step 744.

Similarly, if the LNINT flag is not set at the step 736, it is determined in a step 746 whether the LPINT flag is set (step 720, FIG. 7A). If it is set, it is erased in a step 748 and in a step 750 it is determined whether the dispatch interval for the car (step 732) is less than 4 seconds. If it is less than 4 seconds, it is set to 4 seconds in a step 752 and the routine proceeds to the step 744 to dispatch the car. The thinking behind setting the dispatch interval to 4 seconds in the step 752 is that the passenger who entered the car may not have been the last passenger to board. If the car interval is not less than 4 seconds in the step 750, or if the LPINT flag was not set in the step 746, the routine proceeds directly to the step 744.

In the step 744 it is determined whether the p-car has already been dispatched. If it has not, the dispatch interval for the car is decremented any granularity of time may be applied) in a step 754, and in a step 756 it is determined whether the dispatch interval for the car has expired. If the interval has expired, the car is actually dispatched in a step 758.

If the interval has not expired (step 756 negative), or if there are no calls assigned to the car (FF, step 702, FIG. 7A), or once the car is actually dispatched (step 758), a car counter is decremented in a step 760 so that the next car (p minus 1) in the group will be examined in subsequent passes of the routine. As determined in a step 762, if all of the cars have been examined, the routine proceeds to KL of FIG. 7C. Else the routine proceeds to FG of FIG. 7A to examine the next car (p minus 1).

Figure 7C:
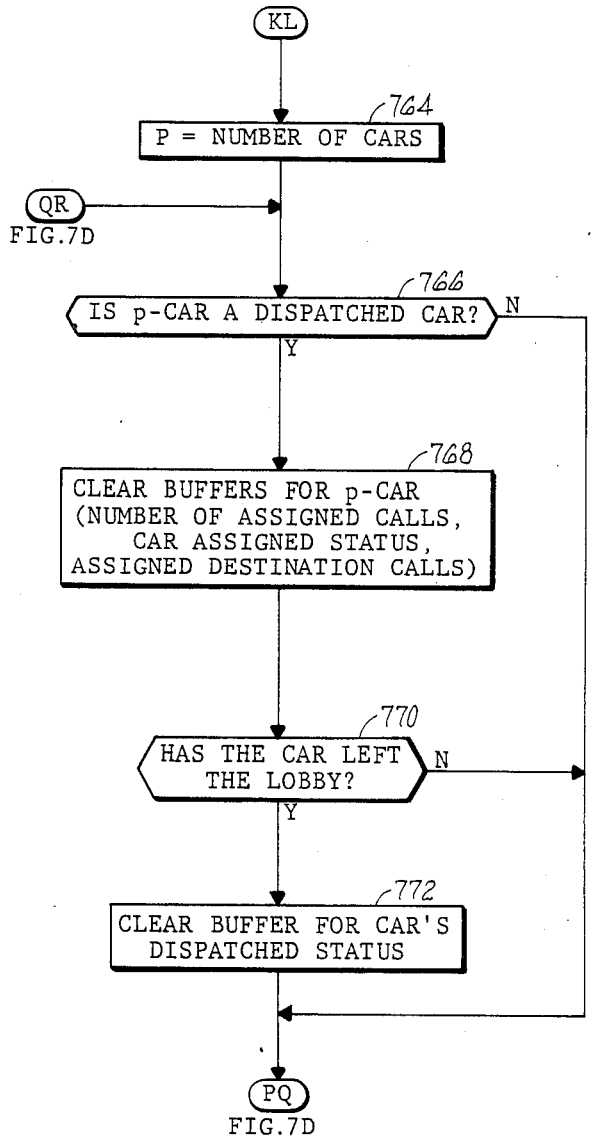

The routine of FIG. 7C is accessed via KL and looks for cars being dispatched, all other cars are bypassed. In a first step 764 the car counter P is set to equal the number of cars. In a step 766, which may be accessed via QR of FIG. 7D (discussed hereinafter) it is determined whether the car being looked at is dispatched. If it is, in a step 768 a plurality of "housekeeping" measures are performed, such as deleting accumulated group assigned calls which were assigned to the car being dispatched so that new calls for the same floor can be assigned to another car, and clearing the car assignment status. Then in a step 770 it is determined whether the dispatched car has left the lobby, for once it has, in a step 772 the car dispatch status signal is cleared and the routine proceeds to PQ of FIG. 7D. If the dispatched car has not yet left the lobby (step 770), or if the car is not yet dispatched (step 766) the routine proceeds directly to PQ of FIG. 7D.

Figures 7C, 7D:
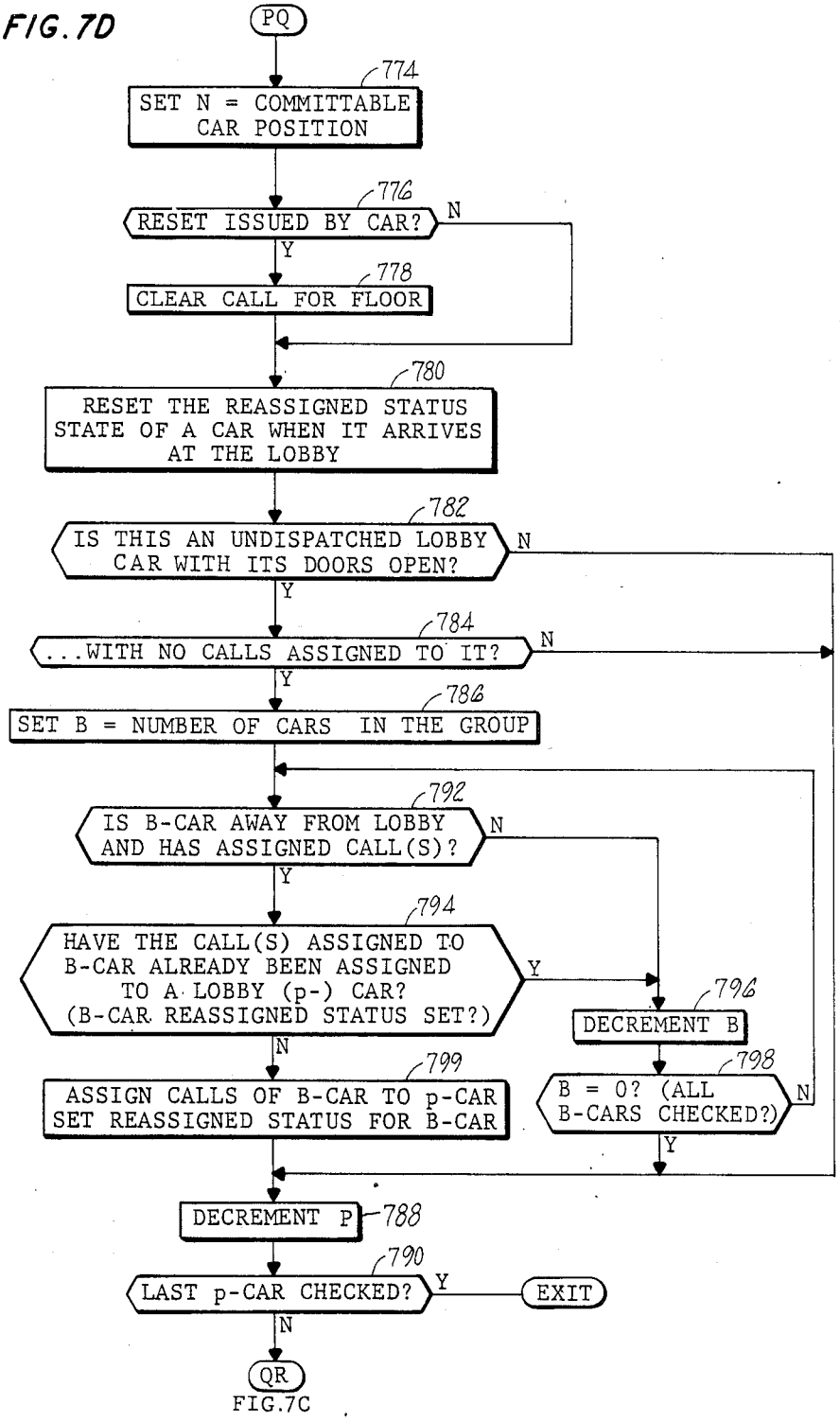

FIG. 7D is the Reset Calls Section of the ACA program. This is a purely operational amenity. Destinations are shown as car calls. In simulation, as well as in a real prototype system, the group must transmit the car calls to the cars. As these are answered in sequence, the cars send back a reset signal to the group to enable it to keep its pending car call arrays current. FIG. 7D also includes code for double assignment of calls, the purpose of which will become evident hereinafter.

The routine of FIG. 7D is accessed via PQ. In a first step 774 a value N is set to equal the commitable position of the car. Then it is determined in a step 776 whether a reset signal has issued by the car. If the reset signal has been issued by the car, in a step 778 the car call bit corresponding to the landing N is cleared in the car call array and the routine proceeds to a step 780. If the reset signal has not been issued by the car, the routine proceeds directly to the step 780.

Beginning with the step 780, some code is performed to alleviate the possibility that a car arrives at the lobby and opens its doors with no calls assigned to it, even when a call is assigned to another car not yet at the lobby. A call entered (in the hall mounted fixture) may be assigned to a down-traveling car of PRIORITY 4 level. Due to unpredictable delays, this car may not arrive at the calculated time, and another car may arrive at the lobby sooner and discharge passengers. This would leave the prospective passenger wondering why his call was assigned to a car not at the lobby. This should be a rare occurrence. It was decided to doubly assign the call rather than to simply reassign it to the lobby car with its door open.

Thus, in the step 780, the reassigned status signal (described below in the step 799) is reset for a car which is arriving at the lobby. This signal pertains only to cars away from the lobby, whose calls have been assigned to another car already at the lobby.

Then in a step 782 it is determined whether the car is a lobby car with its door open that has not been dispatched yet. If so, it is next determined in a step 784 whether the car has no calls assigned to it. If so, the routine proceeds to a step 786. If the car is not at the lobby with its doors open, (step 782) or has any calls assigned to it (step 784) the routine proceeds to a step 788 where a car counter is decremented so that the next (p-1) car can be checked. In a step 790 it is determined whether the last car has been checked—if it has the routine is exited, if it has not the routine proceeds to QR of FIG. 7C to repeat the process for the next car.

Once the lobby car with its doors open and no calls assigned to it is found (again, this should be a rare occurrence) a value B is set in a step 786 wherein B equals the number of cars in the group. Then in a step 792 it is determined whether the B-th car is away from the lobby with calls assigned to it. If so (792 affirmative), it is checked in a step 794 whether this car's calls have already been assigned to a lobby car (by checking whether its reassigned status signal had already been previously set in the step 799). If not (794 negative), in the step 799 the B-car's calls are assigned to the car at the lobby with its doors open (the p-car), and the B-car's reassigned status signal is set in order to prevent a repetitive reassignment of its calls on the next pass of the routine.

If either the result of the step 792 is negative, or the result of the step 794 is affirmative, B is decremented in a step 796. Then in a step 798 it is determined whether all of the B-cars have been checked, the routine proceeds to the step 792. If they have all been checked, the routine proceeds to the step 788.

Thus, it is seen how the technique of this invention optimizes the number of calls assigned to a car during up-peak service intervals.

It should be noted that assignment of calls during other than up-peak service intervals can be handled with the touch pads 16 (of FIG. 1) without optimizing the number of calls assigned to a car or optimizing the dispatch intervals.

As noted hereinbefore, destination call entry devices other than a touch pad are well-suited to this invention. For instance, a touch pad-type transmitter or an encoded card and associated card reader could provide special access features for entry of a destination call. Voice recognition equipment looms on the horizon as a practical input means. In a similar vein, the call indicating device directing passengers to the car which has been assigned their call may provide an audible output, as well as a visual output.

We claim:

1. An elevator system comprising two or more cars servicing a plurality of floors in a building and processor means controlling the motion and door openings of the cars characterized by:

means disposed at a single floor, such as at the lobby, for entering destination calls;

means associated with the processor means for initiating an up-peak service mode;

means associated with the processor means for assigning priority levels to the cars in the up-peak service mode;

means associated with the processor means for determining a maximum number of destination calls to be assigned to a car in the up-peak service mode;

means associated with the processor means for assigning the maximum number of destination calls to the cars in order of their priority level in the up-peak service mode; and means disposed in the lobby for indicating to passengers the destination calls that have been assigned to each car.

2. Apparatus according to claim 1, characterized in that:

the maximum number of destination calls to be assigned to a car is determined as the number of floors above the lobby divided by the number of cars in service.

3. Apparatus according to claim 1 characterized in that:

a. cars at the lobby with their doors open are assigned the highest priority level;

b. cars at the lobby with their doors closed are assigned a lower priority level;

c. cars headed toward the lobby having the lobby as their next stop are assigned a yet lower priority level; and d. the car headed towards the lobby with the soonest predicted arrival time is assigned the lowest priority level.

4. Apparatus according to claim 3 characterized in that the predicted arrival time for a car running toward the lobby not having the lobby as its next stop is based on the number of floors the car is away from the lobby plus the number of calls ahead of the car plus a weighting factor for a call being serviced.

5. Apparatus according to claim 4 characterized in that the weighting factor is:

a. a first value if the car is running with a stop command and its door closed;

b. a second value, lower than the first value, if the car is stopped with its doors just opening;

c. a third value, lower than the second value, if the car is stopped with its doors open and no start command;

d. a fourth value, lower than the third value, if the car is stopped with its doors closing and a start command;

e. a fifth value, lower than the fourth value, if the car is stopped with the doors closed and a start command; and f. a sixth value, lower than the fifth value, if the car is just beginning to run.

6. Apparatus according to claim 3 characterized in that:

calls initially assigned to a nonlobby car are reassigned to a lobby car having its doors open in the event that there is a car at the lobby with its doors open and able to accept calls, thereby eliminating frustration among waiting passengers whose calls were assigned to the car not at the lobby.

7. Apparatus according to claim 1 characterized by:

means for establishing a basic dispatch interval for the cars based on the maximum number of passengers permissible per car multiplied by the ratio of the total number of cars to the number of cars in service.

8. Apparatus according to claim 7 characterized by:

means for adjusting the basic dispatch interval to an individualized dispatch interval for each car based on a car's presence at, or absence from the lobby at the time of its first call assignment(s), the number of calls assigned to it, and the estimated number of passengers on board the car at the lobby based on load measurement; and wherein a provision for a remaining minimum timed interval setting is made for the occurrence of each additional assigned call and for each additional passenger boarding the car.

9. Apparatus according to claim 1 characterized in that destination calls are assigned to cars without assigning the maximum number of calls to each car in order of their priority level when the up-peak mode of service is not initiated.

* * * * *